US010655206B2

(12) United States Patent
Moon et al.

(10) Patent No.: US 10,655,206 B2
(45) Date of Patent: May 19, 2020

(54) SURFACE TREATMENT METHOD OF CERAMIC POWDER USING MICROWAVE PLASMA FOR ENHANCING FLOWABILITY

(71) Applicants: SEWON HARDFACING CO., LTD., Jeonju-si, Jeollabuk-do (KR); KOREA BASIC SCIENCE INSTITUTE, Daejeon (KR)

(72) Inventors: Heung Soo Moon, Jeollanam-do (KR); Pyoung Woo Shin, Mokpo-si (KR); Sae Mee Park, Mokpo-si (KR); Yong Cheol Hong, Goyang-si (KR); Se Min Chun, Gunsan-si (KR); Dong Hun Shin, Daejeon (KR)

(73) Assignee: SEWON HARDFACING CO., LTD. (KR)

( * ) Notice: Subject to any disclaimer, the term of this patent is extended or adjusted under 35 U.S.C. 154(b) by 0 days.

(21) Appl. No.: 16/173,954

(22) Filed: Oct. 29, 2018

(65) Prior Publication Data

US 2019/0300998 A1 Oct. 3, 2019

(30) Foreign Application Priority Data

Mar. 28, 2018 (KR) ..... 10-2018-0035707

(51) Int. Cl.
*C23C 4/02* (2006.01)

(52) U.S. Cl.
CPC ..... *C23C 4/02* (2013.01)

(58) Field of Classification Search
CPC .. C09C 3/00; C09C 3/04; C09C 3/048; C23C 16/50–517; B29B 9/16
See application file for complete search history.

(56) References Cited

U.S. PATENT DOCUMENTS 5,722,602 A * 3/1998 Kelley ..... B22F 1/0096 241/17
2015/0284534 A1* 10/2015 Thierry ..... C08K 5/3417 106/472

* cited by examiner

*Primary Examiner* — Dah-Wei D. Yuan
*Assistant Examiner* — Nga Leung V Law
(74) *Attorney, Agent, or Firm* — Renaissance IP Law Group LLP

(57) ABSTRACT

Disclosed herein is a surface treatment method of a ceramic powder using microwave plasma in order to enhance flowability. The surface treatment method can be applied to a ceramic powder having a small particle size of 45 μm or less and can significantly enhance flowability while reducing an influence on a particle size compared to a conventional method. Consequently, the ceramic particles surface-treated by the above-described surface treatment method can be formed to have a smooth and dense coating film without pores during spray coating.

6 Claims, 10 Drawing Sheets

SURFACE TREATMENT METHOD OF CERAMIC POWDER USING MICROWAVE PLASMA FOR ENHANCING FLOWABILITY

CLAIM FOR PRIORITY

This application claims priority to Korean Patent Application No. 2018-0035707 filed on Mar. 28, 2018 in the Korean Intellectual Property Office (KIPO), the entire contents of which are hereby incorporated by reference.

BACKGROUND

1. Technical Field

Example embodiments of the present disclosure relate in general to a method for enhancing flowability of a ceramic powder for spray coating and more specifically to a surface treatment method of a ceramic powder using microwave plasma for enhancing flowability.

2. Related Art

Micro-sized or nano-sized ceramic powders are used in various fields. Since ceramic powders have characteristics of an insulator and a dielectric substance, ceramic powders are used in fields such as heat blocking, charge transfer blocking, and chemical resistance securing. Further, a powder phase may be provided in the form of a thin film through coating and may be implemented in a specific shape through a green sheet or the like. Furthermore, when a ceramic powder has a high relative dielectric constant, the ceramic powder may be used as a dielectric substance in a capacitor.

For example, a ceramic powder is used for spray coating and the like. As shown in FIG. 1, spray coating is a process of melting a ceramic powder using a flame and spraying the melted ceramic powder on a metal base material at high speed, thereby forming a thin film having a predetermined thickness. The ceramic powder input into the flame is melted on a surface portion rather than completely melted due to an instantaneous high temperature and is coated on the metal base material in the form of a partially melted particle phase. Owing to a pressure and a temperature of the flame, a coating layer has a dense texture. Further, the ceramic powder is exhibited not as individual particles by being coated thereon but as a single film.

The spray coating process mainly employs a metal material as a base material. This is because metal is superior in ductility and malleability but is poor in chemical resistance compared to other materials so there is a problem in that the metal reacts with a specific chemical, a surface of the metal is easily oxidized, and thus the metal is vulnerable to external chemical conditions to be easily corroded. Thus, when a ceramic material is introduced onto a metal base material by spray coating, an external chemical environment is blocked by the coated ceramic layer and thus an inherent characteristic of the metal base material can be maintained for a long period of time.

Further, since ceramic powders are used in various fields, in order to apply the ceramic powders to various applications, various properties required for each application should be satisfied. For example, uniformity of a particle size should be ensured and flowability should be secured.

The uniformity of the particle size means that variation in size between ceramic powders is minimized. When the particle size is uniform, uniformity of electrical characteristics can be secured, and even when a plurality of films are formed, there is an advantage of being capable of obtaining uniform film characteristics. Further, it is also advantageous to secure a uniform degree of dispersion in a dispersion medium during coating.

Flowability refers to a material property in which a phenomenon of densification of ceramic particles is minimized. Particularly, flowability is a very important indicator in a processing process using ceramic particles. Densification of ceramic particles is due to a van der Waals force or electrostatic attraction. For example, when ceramic particles are densified, the ceramic particles densified in a flame during spray coating are factors hindering uniformity of a thin film being formed. Further, when spray coating is performed in a state in which the ceramic particles are not sufficiently dispersed, there occurs a problem in that a particle phase is exhibited on a thin film and does not provide sufficient physical properties.

Furthermore, even in molding of a ceramic product, the densified ceramic particles become factors degrading quality in a process of controlling a shape.

Therefore, various attempts have been made to secure flowability of ceramic particles or to overcome weak flowability in a manufacturing process.

U.S. Pat. No. 7,771,788 discloses a method of preparing spherical particles using ultrasonic waves. The above-described patent document discloses a technique in which a spherical fine powder is prepared without a pulverizing process, a droplet size is controlled using ultrasonic waves, and recombination is prevented by charging. A size of the powder which will be formed is 50 μm or less.

Further, U.S. Pat. No. 7,842,383 discloses a method of preparing an yttrium aluminum garnet (YAG) in which a clogging phenomenon is prevented and flowability is enhanced. In the above-described patent document, granulation and sintering are performed on a primary particle of less than 0.5 μm, the primary particle is pulverized at a pressure of 15 MPa or more to form a secondary particle having a size of less than 6 μm. The secondary particle is used as a spraying powder to obtain high deposition efficiency.

However, according to these patent documents, there is a certain limitation in obtaining high flowability. When a size of a droplet is controlled using ultrasonic waves and the droplet is charged, the droplet having had a short charging time and flowing in a molten state has difficulty in securing sufficient flowability.

Further, when granulation, sintering, and high-pressure pulverizing are used, a certain effect of increasing hardness of the sintered particles can be obtained, but there is a disadvantage in that it is insufficient to secure flowability or mobility.

Consequently, a flowability treatment technique for enhancing flowability of ceramic particles has been studied.

Conventionally, in order to impart a repulsive force, which is a force opposite van der Waals attraction between small particle powders, an organic monomer having polarity has been used. As a specific method, a powder was input into an organic monomer ethanol solution, and the ethanol was evaporated, and then the powder was pulverized to be used as a spraying powder. However, such a flowability method uses and evaporates a large amount of solvent such that there is a disadvantage in that additional material costs and drying costs are required and a large amount of time is consumed during drying.

Consequently, a new flowability treatment method of enhancing flowability of ceramic particles is required.

Thus, in studying a method of enhancing flowability of ceramic particles to be sufficiently dispersed instead of being densified, even in a flame, during spray coating, the present inventors have confirmed that the flowability of ceramic particles has been enhanced to form a smooth, dense and hard coating film without pores during spray coating by treating surfaces of the ceramic particles using microwave plasma under a specific condition, thereby achieving the present disclosure.

PRIOR ART DOCUMENT

Patent Document

1. U.S. Pat. No. 7,771,788
2. U.S. Pat. No. 7,842,383

SUMMARY

Accordingly, example embodiments of the present disclosure are provided to substantially obviate one or more problems due to limitations and disadvantages of the related art.

Example embodiments of the present disclosure provide a surface treatment method of a ceramic powder using microwave plasma for enhancing flowability.

In some example embodiments, a surface treatment method of a ceramic powder includes generating microwave plasma using microwaves under a flow of a swirl gas and a blow gas in a tubular reactor (operation 1), introducing a ceramic powder into the tubular reactor (operation 2), allowing gas ions to be uniformly adsorbed to the ceramic powder in the microwave plasma (operation 3), and collecting and distributing the ceramic powder absorbing the gas ions (operation 4), wherein flowability of the ceramic powder absorbing the gas ions is enhanced compared to a ceramic powder before absorbing the gas ions.

A swirl gas and a blow gas may be any one, or a mixture of two or more, selected from the group consisting of nitrogen gas, oxygen gas, and a fluorine compound gas, or air.

The ceramic powder may include one or more compositions selected from the group consisting of $Al_2O_3$, $Y_2O_3$, yttria stabilized zirconia (YSZ), yttrium aluminum garnet (YAG), mullite, $YF_3$, and YOF.

The ceramic powder may be a spherical or granular powder having a diameter of 45 μm or less.

In the operation 3, the ceramic powder may spirally flow along a flow direction of a swirl gas in the microwave plasma to uniformly absorb the gas ions.

In the operation 3, the ceramic powder may absorb the gas ions and be ionized so that flowability of the ceramic powder may be enhanced by an action of a repulsive force against adjacent powders.

The distributing of the operation 4 may be sieving.

In other example embodiments, a ceramic powder having enhanced flowability due to the above-described surface treatment method is provided.

Flowability of the ceramic powder may be in a range of 1 to 8 g/sec.

BRIEF DESCRIPTION OF DRAWINGS

Example embodiments of the present disclosure will become more apparent by describing in detail example embodiments of the present disclosure with reference to the accompanying drawings, in which.

DESCRIPTION OF EXAMPLE EMBODIMENTS

Figure 1:
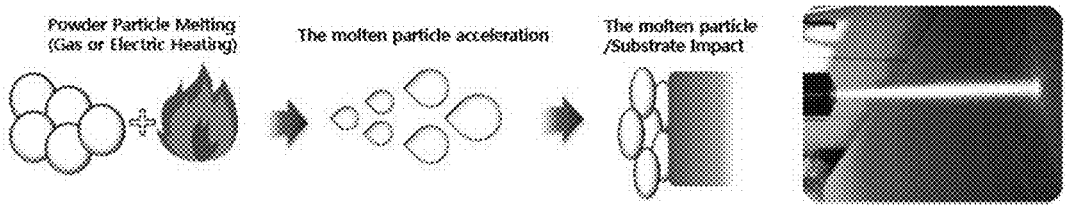
FIG. 1 is a schematic diagram illustrating a mechanism of spray coating.

Example embodiments of the present disclosure are disclosed herein. However, specific structural and functional details disclosed herein are merely representative for purposes of describing example embodiments of the present disclosure, however, example embodiments of the present disclosure may be embodied in many alternate forms and should not be construed as limited to example embodiments of the present disclosure set forth herein.

Accordingly, while the invention is susceptible to various modifications and alternative forms, specific embodiments thereof are shown by way of example in the drawings and will herein be described in detail. It should be understood, however, that there is no intent to limit the invention to the particular forms disclosed, but on the contrary, the invention is to cover all modifications, equivalents, and alternatives falling within the spirit and scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between," "adjacent" versus "directly adjacent," etc.).

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It should also be noted that in some alternative implementations, the functions/acts noted in the blocks may occur out of the order noted in the flowcharts. For example, two blocks shown in succession may in fact be executed substantially concurrently or the blocks may sometimes be executed in the reverse order, depending upon the functionality/acts involved.

Hereinafter, the present disclosure will be described in more detail.

A surface treatment method of a ceramic powder according to the present disclosure includes generating microwave plasma using microwaves under a flow of a swirl gas and a blow gas in a tubular reactor (operation 1), introducing a ceramic powder into the tubular reactor (operation 2), allowing a ceramic powder to uniformly absorb gas ions in the microwave plasma (operation 3), and collecting and distributing the ceramic powder which absorbs the gas ions (operation 4).

The present disclosure may be modified in various forms and may have a variety of embodiments, and, therefore, specific embodiments will be illustrated in the drawings and a description thereof will be described in detail in the following description. The embodiments to be disclosed below, therefore, are not to be taken in a sense which limits the present disclosure to specific embodiments, and should be construed to include modification, equivalents, or substitutes within the spirit and technical scope of the present disclosure. In describing each drawing, a similar reference numeral is given to a similar component.

Figure 2:
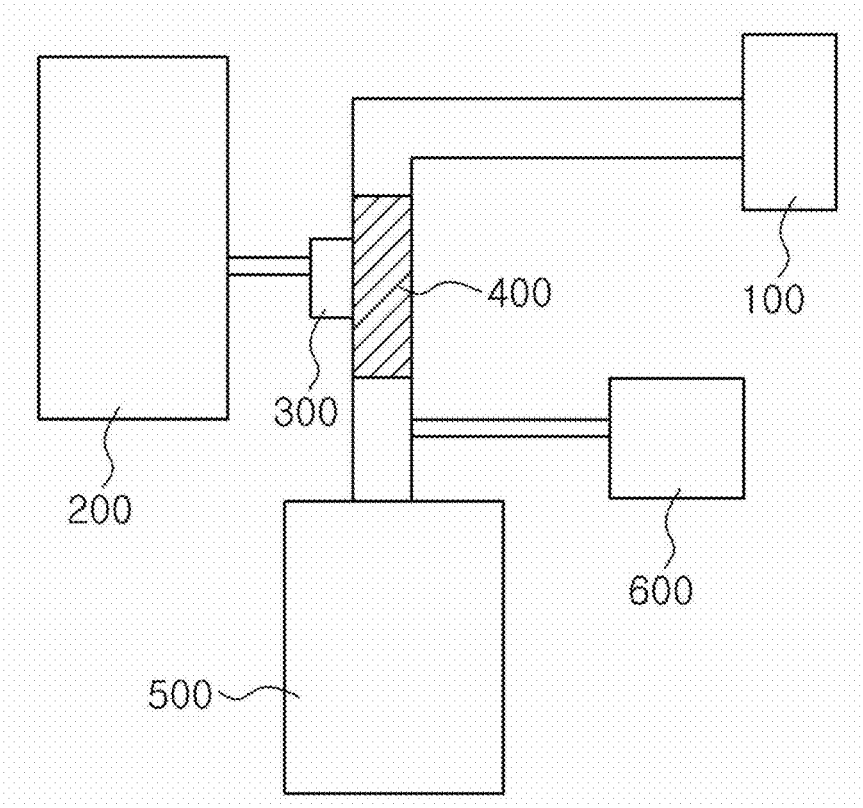
FIG. 2 is a schematic diagram of a microwave plasma system used to enhance flowability of a ceramic powder according to one embodiment of the present disclosure.

FIG. 2 is a schematic diagram of a microwave plasma system used to enhance flowability of a ceramic powder for spray coating according to one embodiment of the present disclosure.

The microwave plasma system includes a material introduction part 100 for introducing a material, a microwave generator 200, a plasma generator 300, a reactor 400, a powder collector 500, and a dust collector 600.

The operation 1 is an operation of generating microwave plasma.

Particularly, in the operation 1, the microwave plasma is generated using microwaves under a flow of a swirl gas and a blow gas in the reactor 400 using the swirl gas as a source.

In a method for enhancing flowability of a ceramic powder for spray coating according to the present disclosure, the microwave plasma is generated by inducing a gas discharge using microwaves on the ground, i.e., at atmospheric pressure to ionize molecules so that the microwave plasma may easily generate a large amount of free radicals. When the microwave plasma is generated in the atmosphere, even though the temperature of electrons in the microwave plasma is a temperature in the tens of thousands, the temperature of neutral particles or ions corresponds to room temperature so that an overall temperature of the microwave plasma is not very high. Since the electrons in the microwave plasma interact with the neutral particles to turn the neutral particles into an excited energy state, highly efficient chemical reactions may be induced such that a large amount of chemical treatments may be performed with a small amount of energy.

In the operation 1, the swirl gas serves to supply a gas required for plasma formation and to transport the ceramic powder, and the blow gas serves to cool the ceramic powder passing through the microwave plasma and to transport the ceramic powder to the powder collector 500.

In this case, the swirl gas and the blow gas may employ any one, or a mixture of two or more, selected from the group consisting of nitrogen gas, oxygen gas, and a fluorine compound gas, or air. The air contains nitrogen and oxygen. Alternatively, any gas capable of enhancing powder flowability due to gas adsorption by a plasma treatment may be used without limitation.

A flow rate of each of the swirl gas and the blow gas may be adjusted and used according to an amount of the ceramic powder being introduced, but when the flow rate exceeds 1,000 lpm, the ceramic powder may flow back, be over melted, and thus be fused onto an inner wall of the reactor 400.

In the operation 1, power of the microwaves may be adjusted and used according to the amount of the ceramic powder which being introduced, but when the power exceeds 300 kW, the ceramic powder may be completely melted and block the inner wall of the reactor 400.

Next, the operation 2 is an operation of introducing the ceramic powder into the microwave plasma.

The ceramic powder may include one or more compositions selected from the group consisting of $Al_2O_3$, $Y_2O_3$, yttria stabilized zirconia (YSZ), yttrium aluminum garnet (YAG), mullite, $YF_3$, and YOF, but the present disclosure is not particularly limited thereto. Further, the ceramic powder may employ a spherical or granular powder having a fine size of 45 μm or less in diameter, preferably in the range of 5 μm to 25 μm. Alternatively, various kinds of ceramic particles may be used.

A granular powder may be prepared through various methods. For example, the granular powder may be formed through formation and cooling of droplets using ultrasonic vibration. That is, a ceramic melt solution is introduced into a nozzle, and the nozzle performs ultrasonic vibration. A piezoelectric vibrator is used for performing ultrasonic vibration. An approximately circular piezoelectric vibrator has an intrinsic resonance frequency and performs thickness vibration according to an applied resonance frequency. Consequently, the nozzle vibrates at the applied resonance frequency, and a droplet is formed according to the applied resonance frequency. A size of the droplet mainly depends on a diameter of the nozzle and is also influenced by the applied resonance frequency.

Alternatively, the granular powder may be formed by spraying, drying and distributing through a plasma gun, and a prepared ceramic powder may be obtained and used as the granular powder.

The ceramic powder is introduced into the material introduction part 100 in the plasma system of FIG. 2. In this case, an increase in introduction amount of the ceramic powder is better in order to improve a production amount, but when a large amount of the ceramic powder is introduced compared to power, it is difficult for a plasma ion treatment to be performed on all the ceramic powder particles so that a degree of flowability enhancement may be lowered somewhat.

Next, the operation 3 is an operation in which gas ions are uniformly adsorbed to the ceramic powder in the microwave plasma.

The ceramic powder flows to the tubular reactor 400 by a flow of the swirl gas and the blow gas in the material introduction part 100 to pass through the microwave plasma.

Figure 3:
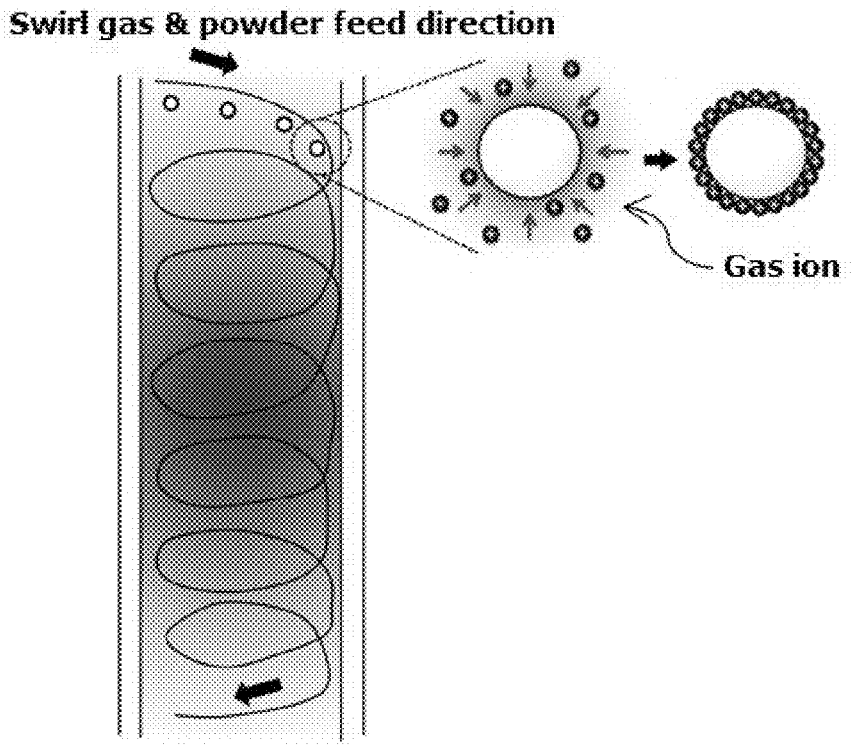
FIG. 3 is a mimetic diagram illustrating the principle of flowability enhancement of a ceramic powder for spray coating in microwave plasma according to one embodiment of the present disclosure.

In this case, as shown in FIG. 3, the ceramic powder spirally flows along a flow direction of the swirl gas in the microwave plasma, and a time at which the ceramic powder stays in the microwave plasma is prolonged such that gas ions of the microwave plasma may uniformly be adsorbed onto a surface of the ceramic powder. The gas ions adsorbed onto the ceramic powder are combined with cations of a metal constituting ceramic particles to form polarization over the entire surfaces of the ceramic particles such that flowability of the ceramic powder is enhanced by an action of a repulsive force against adjacent powders.

Next, the operation 4 is an operation of collecting and distributing the ceramic powder absorbing the gas ions.

The ceramic powder adsorbing the gas ions is collected by a cyclone and is moved to the powder collector 500, and the used gases pass through the dust collector 600.

The distributing may be performed by various methods known in the art, of which sieving is preferable, but the present disclosure is not limited thereto.

Further, according to the surface treatment method of the present disclosure, a ceramic powder having enhanced flowability is provided. In this case, flowability of the ceramic powder may be 1.0 g/sec or more, and preferably in the range of 1 to 8 g/sec for smooth spray coating.

Figure 8:
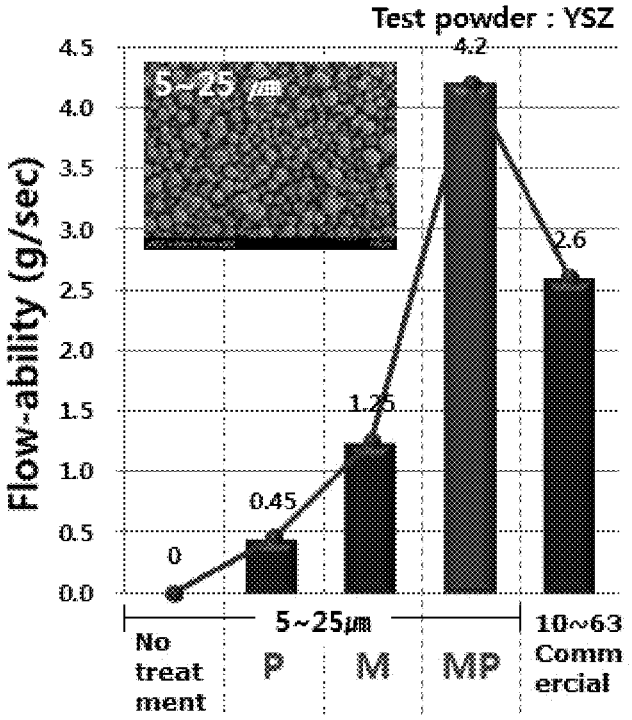
FIG. 8 is a graph showing variations in flowability of a commercially available powder for spray coating and a powder for enhancing flowability according to a conventional surface treatment method or a surface treatment method of the present disclosure in yttria stabilized zirconia (YSZ) powders of one embodiment of the present disclosure and a Comparative Example, and in FIG. 8, a SEM photograph in the graph shows a surface of the YSZ powder after a microwave plasma treatment according to one embodiment of the present disclosure.

As shown in FIG. 8, a portion of a surface of an YSZ ceramic powder in which the gas ions were uniformly adsorbed onto the surface of the ceramic powder by a microwave plasma treatment according to the present disclosure was smoothed, and when flowability was measured, flowability of the YSZ ceramic powder was enhanced to 4.2 g/sec compared to before a plasma treatment (0 g/sec) so that it can be seen that the flowability of the YSZ ceramic powder was enhanced about three times higher than flowability of each of a conventional polymer treatment (0.45 g/sec) and a conventional monomer treatment (1.25 g/sec).

Figure 10:
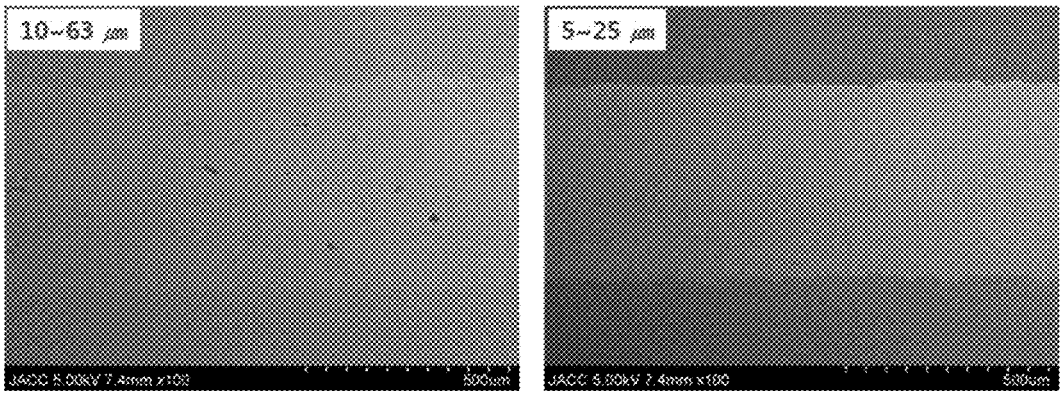
FIG. 10 is a SEM photograph showing a surface of a spray coating layer formed using a ceramic powder having enhanced flowability by the surface treatment method according to the present disclosure.
Figure 11:
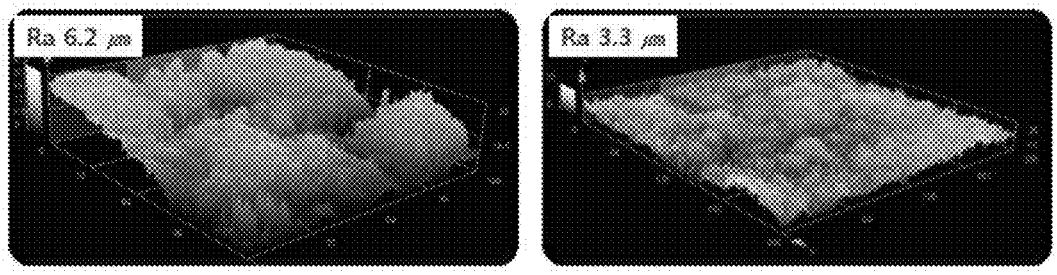
FIG. 11 is a SEM photograph showing surface coarseness of the spray coating layer formed using the ceramic powder having enhanced flowability due to the surface treatment method according to the present disclosure.

Further, when actual spray coating is performed with the ceramic powder having enhanced flowability by the surface treatment method of the present disclosure, a dense coating film was formed without pores as shown in FIG. 10, and a surface coarseness of the dense coating layer was also significantly reduced as shown in FIG. 11.

Therefore, the surface treatment method of the ceramic powder using microwaves according to the present disclosure may be applied to a ceramic powder having a small particle size in the range of 5 μm to 25 μm and may significantly enhance flowability while reducing an influence on a particle size. Consequently, the ceramic particles surface-treated by the above-described surface treatment method may be formed to have a smooth coating film without pores during spray coating.

Hereinafter, the present disclosure will be described in detail with reference to Examples and Experimental Examples. However, the following Examples are illustrative of the present disclosure, and the contents of the present disclosure are not limited by the following Examples.

<Preparation Example> Preparation of Granular Powder $Al_2O_3$, $Y_2O_3$, and YSZ granular powders having particle sizes in the range of 5 μm to 25 μm were prepared through formation and cooling of droplets using ultrasonic vibration, which is a method known in the art.

<Example 1> Preparation of $Al_2O_3$ Powder Having Enhanced Flowability Through Microwave Plasma Treatment A granular $Al_2O_3$ powder, which was prepared in the Preparation Example, was treated with microwave plasma using the microwave plasma system of FIG. 2.

A plasma treatment condition is as follows.

Power: 3.6 kW

Gas type: air

Input amount of powder: 400 g/hr

Figure 4:
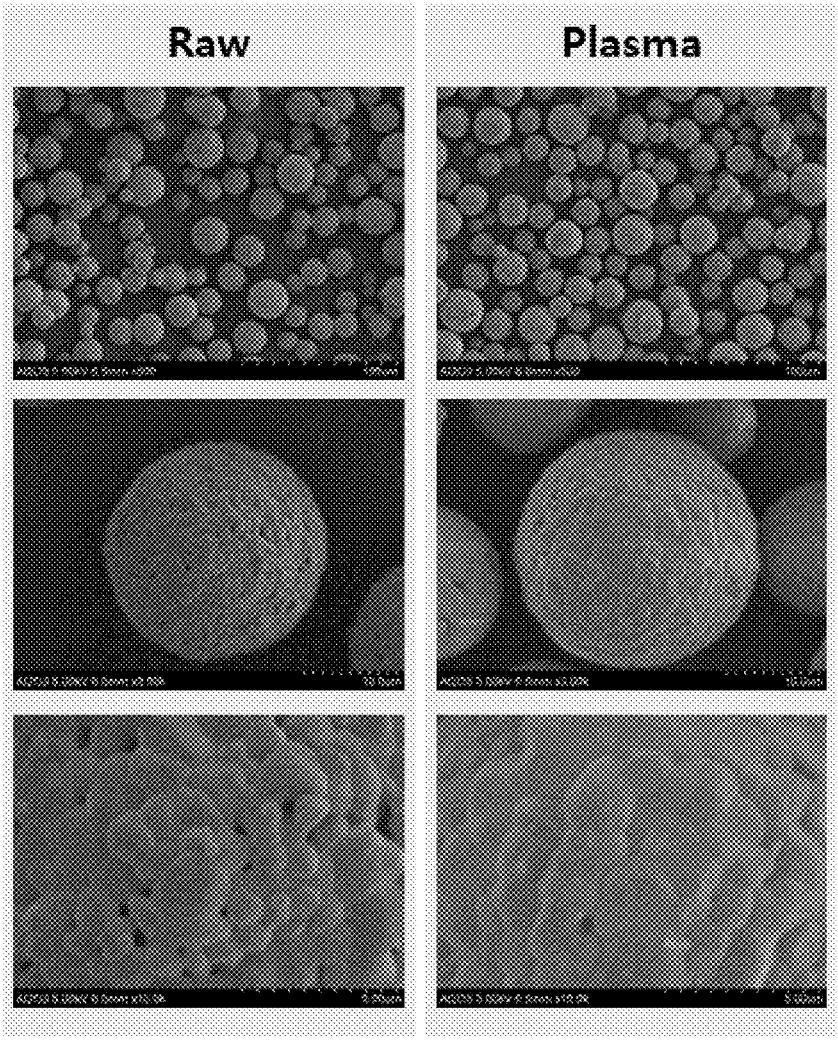
FIG. 4 is a scanning electron microscope (SEM) photograph showing a surface of an Al2O3 powder before and after a microwave plasma treatment in one embodiment of the present disclosure.

A surface of the powder before and after the plasma treatment was observed with a SEM and was shown in FIG. 4.

FIG. 4 is photographs comparing $Al_2O_3$ powders before and after the plasma treatment.

As shown in FIG. 4, the $Al_2O_3$ powder before the plasma treatment exhibited an irregular size distribution. Further, the $Al_2O_3$ powder after the plasma treatment exhibited an irregular size distribution.

When the $Al_2O_3$ powder before the plasma treatment is enlarged, many pores appear on a surface of the $Al_2O_3$ powder. Even after the plasma treatment, a plurality of pores appear on the surface of the $Al_2O_3$ powder. The plurality of pores contribute to increase a surface area of the ceramic particle.

Next, a particle size analysis of the $Al_2O_3$ powder before and after the plasma treatment was carried out and was shown in Table 1. The following Table 1 shows average particle size analysis data for three kinds of samples.

TABLE 1

| Distribution | Before plasma treatment (μm) | After plasma treatment (μm) |
|---|---|---|
| D10 | 11.27 | 11.48 |
| D50 | 18.46 | 20.09 |
| D90 | 26.57 | 28.98 |

As shown in Table 1, an $Al_2O_3$ particle having a relatively small size and being relatively easily melted by the plasma treatment is considered to be melted or absorbed by an $Al_2O_3$ particle having a large size. Further, it is expected that some components of a gas supplied during the plasma treatment are adsorbed or chemically bonded onto a surface of the $Al_2O_3$ particle. Therefore, it can be seen that a particle size is increased in the range of 1.86% to 9.07% by the plasma treatment. The increase in particle size relates to a temperature during the plasma treatment. When the temperature during the plasma treatment is high, a rate of increment in particle size rises, and when the temperature during plasma treatment is relatively low, the rate of increment in particle size decreases.

Figure 5:
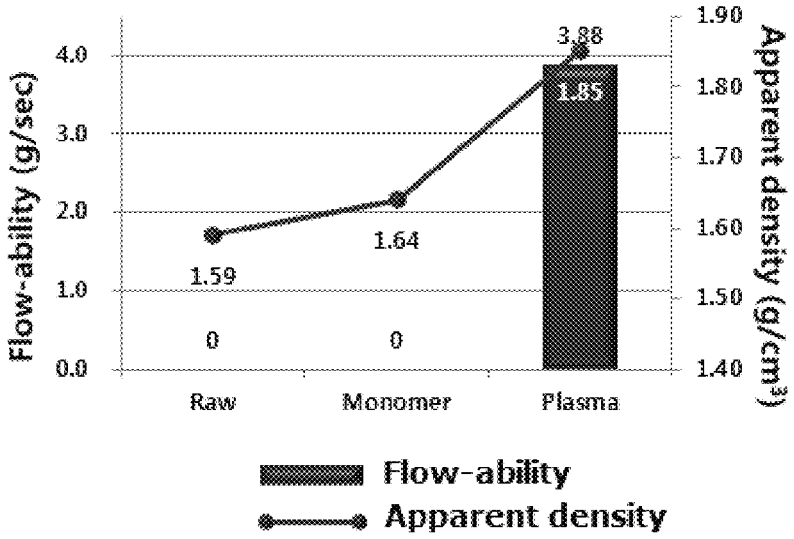
FIG. 5 is a graph showing variations in flowability and apparent density of the $Al_2O_3$ powder before and after the microwave plasma treatment in one embodiment of the present disclosure.

Further, flowability and apparent density of the $Al_2O_3$ powder before and after the plasma treatment were measured and shown in FIG. 5.

A measurement method for the flowability and the apparent density was performed using a measuring instrument according to Korean Industrial Standards.

As shown in FIG. 5, the apparent density of the $Al_2O_3$ powder before the plasma treatment exhibited a value of 1.59, while, after the plasma treatment, the apparent density thereof exhibited a value of 3.88. Consequently, it can be seen that the same fine $Al_2O_3$ particles are absorbed by $Al_2O_3$ particles having relatively large sizes during the plasma treatment.

Further, the flowability of the $Al_2O_3$ powder before the plasma treatment was 0 g/sec, while the flowability thereof after the plasma treatment was 1.85 g/sec so it can be seen that the flowability thereof is significantly increased.

Therefore, the method according to the present disclosure can effectively enhance flowability of a powder for spray coating.

<Example 2> Preparation of $Y_2O_3$ Powder Having Enhanced Flowability Through Microwave Plasma Treatment A granular $Y_2O_3$ powder was subjected to a microwave plasma treatment by the same method as in Example 1.

Figure 6:
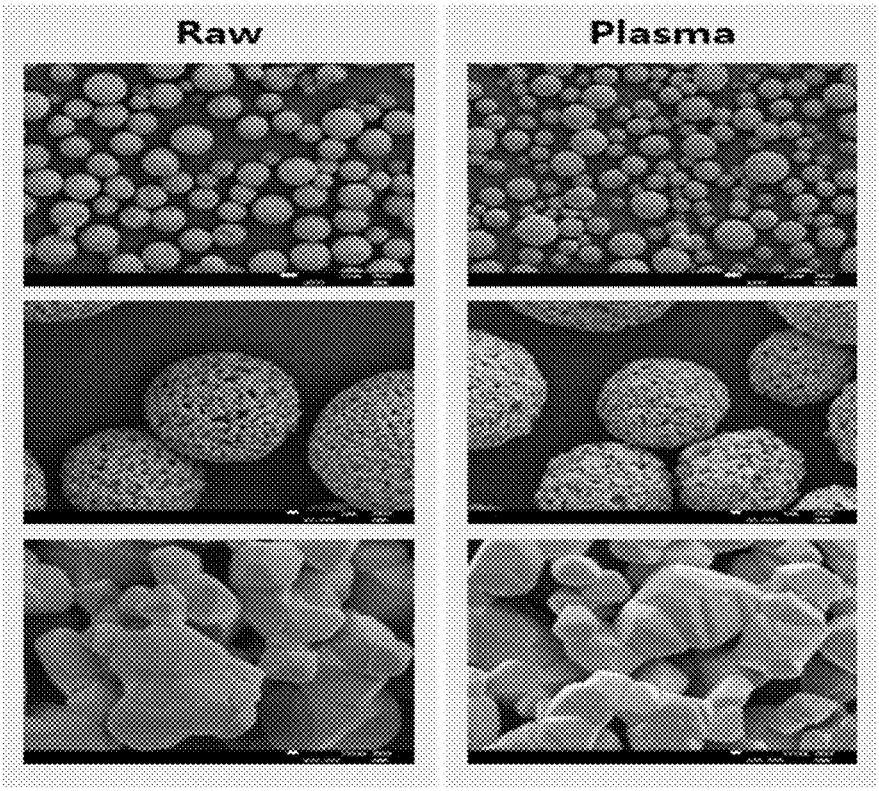
FIG. 6 is a SEM photograph showing a surface of a $Y_2O_3$ powder before and after a microwave plasma treatment in one embodiment of the present disclosure.

FIG. 6 is photographs obtained and compared by observing a surface of the $Y_2O_3$ powder before and after the plasma treatment with a SEM.

As shown in FIG. 6, the $Y_2O_3$ powder before the plasma treatment exhibited an irregular size distribution. Further, the $Y_2O_3$ powder after the plasma treatment exhibited an irregular size distribution.

When the $Y_2O_3$ powder before the plasma treatment is enlarged, many pores appear on a surface of the $Y_2O_3$ powder. After the plasma treatment, a plurality of pores appear on the surface of the $Y_2O_3$ powder. The plurality of pores contribute to increase a surface area of the ceramic particle.

Next, a particle size analysis of the $Y_2O_3$ powder before and after the plasma treatment was carried out and was shown in Table 2. The following Table 2 shows average particle size analysis data for three kinds of samples.

TABLE 2

| Distribution | Before plasma treatment (μm) | After plasma treatment (μm) |
|---|---|---|
| D10 | 14.16 | 12.19 |
| D50 | 19.02 | 19.01 |
| D90 | 26.55 | 26.10 |

Referring to Table 2, it can be seen that the particle size is decreased after the plasma treatment. A decrement appears to be substantially insignificant. This means that a $Y_2O_3$ particle is partially melted or a texture thereof becomes somewhat dense due to the plasma treatment.

Figure 7:
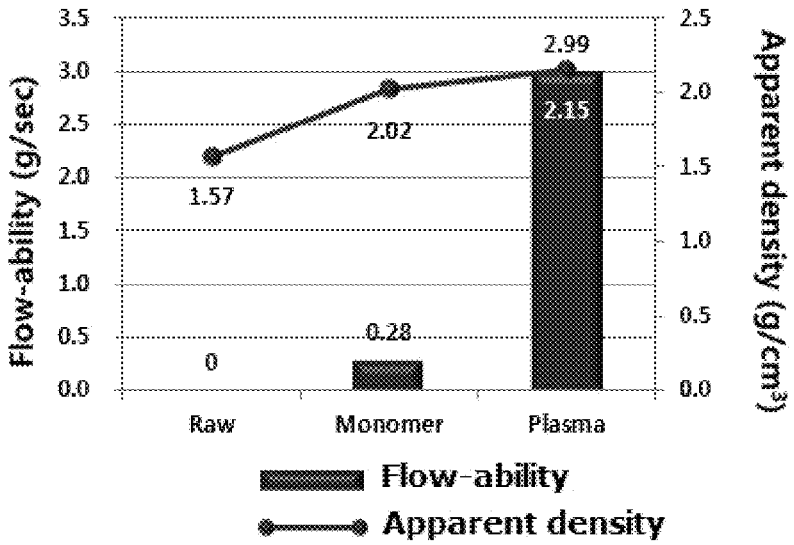
FIG. 7 is a graph showing variations in flowability and apparent density of the $Y_2O_3$ powder before and after the microwave plasma treatment in one embodiment of the present disclosure.

Further, flowability and apparent density of the $Y_2O_3$ powder before and after the plasma treatment were measured and shown in FIG. 7.

As shown in FIG. 7, the apparent density of $Y_2O_3$ before plasma treatment exhibited a value of 1.57, while the apparent density thereof after plasma treatment increased to a value of 2.99. This represents that some of pores formed on a surface of the $Y_2O_3$ particle are buried or partially melted by the plasma treatment such that a surface area of the $Y_2O_3$ is slightly reduced. However, the photographs show a state in which the pores of the surface of $Y_2O_3$ do not completely disappear or deformation thereof does not occur, and it is numerically considered that some pores are buried or a recessed structure of the pore is embedded somewhat.

Further, the flowability of the $Y_2O_3$ powder before the plasma treatment was 0 g/sec, while the flowability thereof after the plasma treatment was 2.15 g/sec so that it can be seen that the flowability is significantly increased.

Therefore, the method according to the present disclosure can effectively enhance flowability of a powder for spray coating.

Referring to the analysis results shown in FIGS. 4 to 7, it is preferable that the apparent density is slightly increased or maintained at the same level by the plasma treatment. That is, it is necessary for a surface structure of the ceramic particle to be visually maintained. This is a part at which the surface area plays a considerable role as a factor determining flowability. Further, even though the apparent density increases through the plasma treatment, a variation in particle size needs to be small.

<Example 3> Preparation of YSZ Powder Having Enhanced Flowability Through Microwave Plasma Treatment A granular YSZ powder having a diameter in the range of 5 μm to 25 μm was subjected to a microwave plasma treatment by the same method as in Example 1.

<Comparative Example 1> Preparation of YSZ Powder with Enhanced Flowability Through Conventional Flowability Treatment The granular YSZ powder having a diameter in the range of 5 μm to 25 μm was subjected to a polymer treatment according to a conventional flowability treatment method (PCT/KR2016/010071).

<Comparative Example 2> Preparation of YSZ Powder with Enhanced Flowability Through Conventional Flowability Treatment The granular YSZ powder having a diameter in the range of 5 μm to 25 μm was subjected to a monomer treatment according to a conventional flowability treatment method (PCT/KR2016/010071).

<Comparative Example 3>

A commercially available YSZ powder having a diameter in the range of 10 μm to 63 μm was used as a powder for spray coating.

<Experimental Example 1> Measurement of Flowability Variation According to Surface Treatment Method of Ceramic Powder An experiment was carried out to evaluate a variation in flowability according to the surface treatment method of the ceramic powder.

Flowability for each of the granular YSZ powder having a diameter in the range of 5 μm to 25 μm, which is prepared in the Preparation Example and is not surface-treated, the granular YSZ powder having a diameter in the range of 5 μm to 25 μm, which is subject to a polymer treatment or a monomer treatment according to the conventional flowability treatment method in Comparative Example 1 or 2, the granular YSZ powder having a diameter in the range of 5 μm to 25 μm, which is subject to the microwave plasma treatment of the present disclosure according to Example 3, and the commercially available YSZ powder having a diameter in the range of 10 μm to 63 μm according to Example 3 was measured and shown in FIG. 8.

As shown in FIG. 8, the flowability of the YSZ ceramic powder is exhibited as 0 g/sec before the surface treatment, 0.45 g/sec when the polymer treatment P was performed, and 1.25 g/sec when the monomer treatment M was performed. When the microwave plasma treatment MP according to the present disclosure was performed, the flowability is exhibited as 4.2 g/sec and was enhanced about three times when compared with the conventional method. The flowability is about two times higher than flowability (2.6 g/sec) of commercially available powder having a relatively large particle for spray coating.

In the case of a conventional polymer or organic monomer, a molecule has a branch, whereas in the case of the flowability treatment using plasma, smaller ions are absorbed and an adsorption amount is significantly increased such that it is assumed that the flowability is enhanced more significantly.

Therefore, the method according to the present disclosure can effectively enhance flowability even in the case of a powder having a smaller particle.

<Experimental Example 2> Measurement of Variation in Flowability According to Gas Ratio ($N_2/O_2$)

In the surface treatment method of a ceramic powder using microwave plasma according to the present disclosure, the following experiment was carried out in order to evaluate a variation in flowability according to a ratio ($N_2/O_2$) of gases generating plasma.

Particularly, the flowability was measured by varying the ratio ($N_2/O_2$) of the gases in the range of 30/0 to 0/30 with respect to the $Y_2O_3$ powder having a diameter in the range of 5 μm to 25 μm. Thereafter, the flowability was measured again after 3 hours, 4 days, 8 days and 12 days for each ratio, and the results were shown in FIG. 9.

Figure 9:
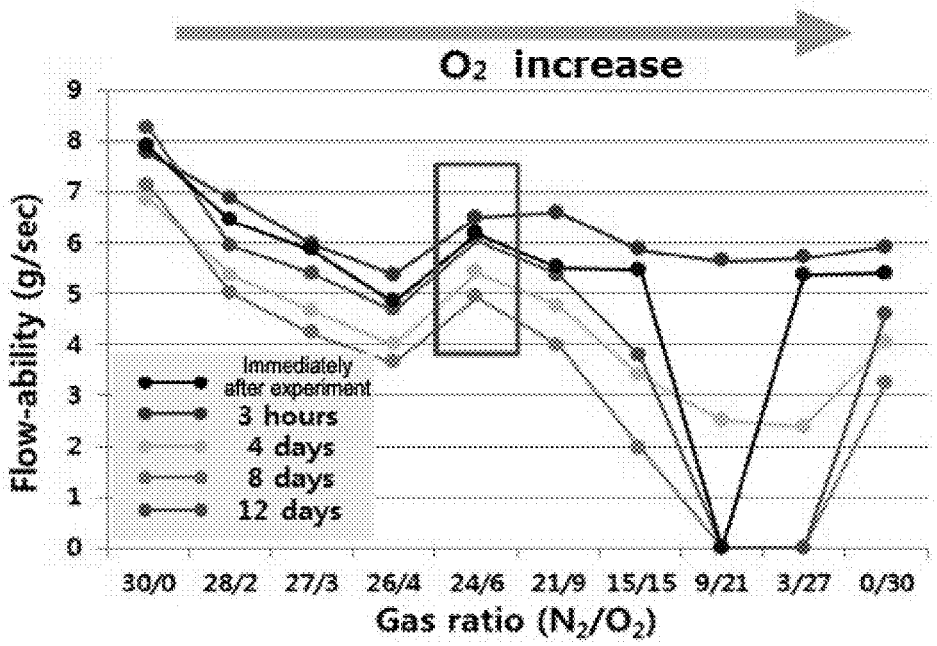
FIG. 9 is a graph showing variations in flowability according to a ratio ($N_2/O_2$) of gases, which will be introduced, in the surface treatment method of a powder according to one embodiment of the present disclosure.

As shown in FIG. 9, when only nitrogen was introduced, the flowability was exhibited as being highest, and next, when a ratio of nitrogen to oxygen was 24/6, the flowability was exhibited as being higher. Further, it can be seen that a decrement in flowability decreases with the passage of time.

Therefore, it can be seen that a preferable gas ratio during the plasma treatment is that using only nitrogen or a ratio of nitrogen to oxygen=24/6.

<Experimental Example 3> Spray Coating Using Ceramic Powder Having Enhanced Flowability The following experiment was carried out to evaluate an influence of the surface treatment method of a ceramic powder using microwave plasma according to the present disclosure on spray coating.

Figure 12:
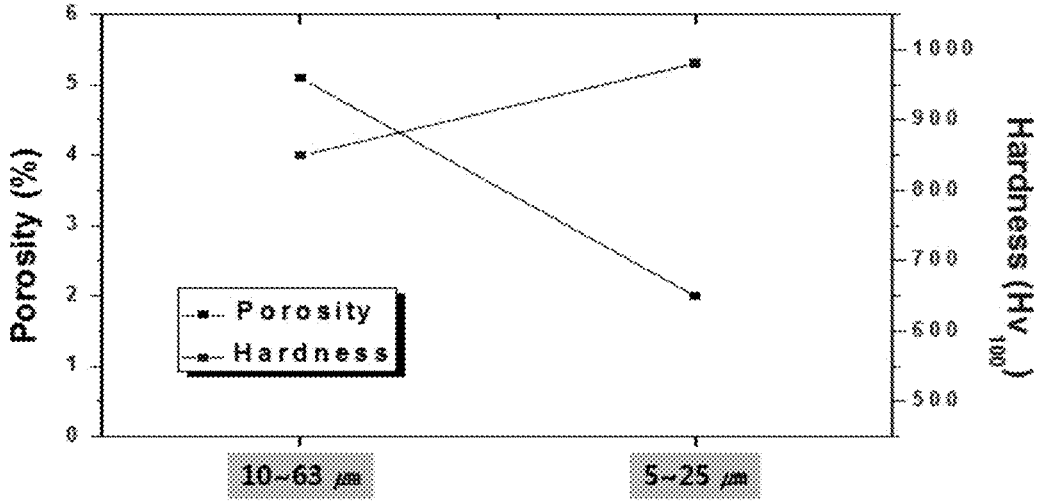
FIG. 12 is a graph showing porosity rate and a hardness value of the spray coating layer formed using the ceramic powder having enhanced flowability due to the surface treatment method according to the present disclosure.

Particularly, the $Y_2O_3$ powder having a diameter in the range of 10 μm to 63 μm and in the range of 5 μm to 25 μm was subjected to the microwave plasma treatment according to the present disclosure, spray coating was performed to measure physical properties of a coating film, and the results were shown in FIGS. 10 to 12.

Spray coating equipment (TripleX pro 200) was used for spray coating, and a spray coating condition was as follows.

Current (A): 500 A
Gun distance: 150 mm
Gun speed: 1000 mm/sec
Pitch: 3 mm
Gas ratio (Ar:He): 45:5
Power: 90 KW
Powder introduction rate: 30 g/min
Nozzle diameter: 9 mm FIG. 10 is a SEM photograph showing a surface of a spray coating layer formed using a ceramic powder having enhanced flowability by the surface treatment method according to the present disclosure;

As shown in FIG. 10, in the case of the powder having a diameter in the range of 10 μm to 63 μm, some pores were formed on the coating layer after the plasma treatment, while in the case of the powder having a diameter in the range of 5 μm to 25 μm, the coating layer was densely formed without pores after the plasma treatment.

FIG. 11 is SEM photographs showing surface coarseness of the spray coating layer formed using the ceramic powder having enhanced flowability by the surface treatment method according to the present disclosure, wherein a left SEM photograph shows a coating layer coated with a powder having a diameter in the range of 10 μm to 63 μm by spray coating and a right SEM photograph shows a coating layer coated with a powder having a diameter in the range of 5 μm to 25 μm by spray coating.

As shown in FIG. 11, it can be seen that in the case of the powder having the diameter in the range of 10 μm to 63 μm, a coarse surface of the coating layer is exhibited even after the plasma treatment, while in the case of the powder having the diameter in the range of 5 μm to 25 μm, the coarse surface of the coating layer was significantly reduced.

FIG. 12 is a graph showing porosity rate and a hardness value of the spray coating layer formed using the ceramic powder having enhanced flowability by the surface treatment method according to the present disclosure.

As shown in FIG. 12, when compared to the powder having the diameter in the range of 10 μm to 63 μm, in the case of the powder having the diameter in the range of 5 μm to 25 μm, porosity rate after the plasma treatment was significantly decreased and a hardness value was increased.

Therefore, the fine ceramic powder having the diameter in the range of 5 μm to 25 μm, which has been surface-treated by the above-mentioned method, can form a dense and hard coating film without pores during spray coating.

The surface treatment method of the ceramic powder using microwaves according to the present disclosure can be applied to a ceramic powder having a small particle size in the range of 5 μm to 25 μm and can significantly enhance flowability while reducing an influence on a particle size compared to a conventional method. Therefore, the ceramic particles surface-treated by the above-described surface treatment method can be formed to have a smooth, dense, and hard coating film without pores during spray coating.

While the example embodiments of the present disclosure and their advantages have been described in detail, it should be understood that various changes, substitutions and alterations may be made herein without departing from the scope of the invention.

What is claimed is:

1. A surface treatment method of a ceramic powder, comprising:

generating microwave plasma at atmospheric pressure using microwaves under a flow of a swirl gas and a blow gas in a tubular reactor;

introducing a ceramic powder into the tubular reactor in which the microwave plasma is generated;

allowing gas ions to be evenly adsorbed to the ceramic powder in the microwave plasma; and collecting and distributing the ceramic powder absorbing the gas ions, wherein, in allowing gas ions to be evenly adsorbed to the ceramic powder in the microwave plasma, the ceramic powder spirally flows along a flow direction of a swirl gas in the microwave plasma to uniformly absorb the gas ions; and wherein flowability of the ceramic powder absorbing the gas ions is enhanced compared to the ceramic powder before absorbing the gas ions.

2. The surface treatment method of claim 1, wherein a swirl gas and a blow gas are any one selected from the group consisting of any one, or a mixture of two or more, selected from the group consisting of nitrogen gas, oxygen gas, and a fluorine compound gas, or air.

3. The surface treatment method of claim 1, wherein the ceramic powder includes one or more compositions selected from the group consisting of $Al_2O_3$, $Y_2O_3$, yttria stabilized zirconia (YSZ), yttrium aluminum garnet (YAG), mullite, $YF_3$, and YOF.

4. The surface treatment method of claim 1, wherein the ceramic powder is a spherical or granular powder having a diameter of 45 μm or less.

5. The surface treatment method of claim 1, wherein, in allowing gas ions to be evenly adsorbed to the ceramic powder in the microwave plasma, the gas ions adsorbed onto the ceramic powder are combined with cations of a metal constituting ceramic particles to form polarization over the entire surfaces of the ceramic particles such that flowability of the ceramic powder is enhanced by an action of a repulsive force against adjacent powders.

6. The surface treatment method of claim 1, wherein collecting and distributing the ceramic powder absorbing the gas ions comprises is sieving.

* * * * *